US008062994B2

(12) United States Patent
Masuda et al.

(10) Patent No.: US 8,062,994 B2
(45) Date of Patent: Nov. 22, 2011

(54) THERMAL RECORDING MATERIAL AND PROCESS FOR THE PRODUCTION THEREOF

(75) Inventors: Takao Masuda, Tokyo (JP); Takahito Ochiai, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 12/733,903

(22) PCT Filed: Sep. 29, 2008

(86) PCT No.: PCT/JP2008/068121

§ 371 (c)(1),
(2), (4) Date: Jun. 18, 2010

(87) PCT Pub. No.: WO2009/041744

PCT Pub. Date: Apr. 2, 2009

(65) Prior Publication Data

US 2011/0053769 A1 Mar. 3, 2011

(30) Foreign Application Priority Data

Sep. 28, 2007 (JP) ..... 2007-253948
Jul. 31, 2008 (JP) ..... 2008-198106

(51) Int. Cl.
*B41M 5/42* (2006.01)
*B41M 3/12* (2006.01)

(52) U.S. Cl. ..... 503/226; 427/152; 503/200

(58) Field of Classification Search ..... None
See application file for complete search history.

(56) References Cited

U.S. PATENT DOCUMENTS

| | | | |
|---|---|---|---|
| 2003/0039917 A1 | 2/2003 | Naruse et al. | |
| 2007/0184978 A1 | 8/2007 | Takano et al. | |

FOREIGN PATENT DOCUMENTS

| | | | |
|---|---|---|---|
| JP | 2000-15932 | | 1/2000 |
| JP | 2002-127601 | * | 5/2002 |
| JP | 2002-283717 | | 10/2002 |
| JP | 3716736 | | 9/2005 |
| JP | 2005-335295 | | 12/2005 |
| JP | 2006-82373 | | 3/2006 |
| JP | 2007-230233 | | 9/2007 |

OTHER PUBLICATIONS

International Search Report issued Nov. 11, 2008 in International (PCT) Application No. PCT/JP2008/068121.
Written Opinion mailed Nov. 11, 2008 in International (PCT) Application No. PCT/JP2008/068121.

* cited by examiner

*Primary Examiner* — Bruce H Hess
(74) *Attorney, Agent, or Firm* — Wenderoth, Lind & Ponack, L.L.P.

(57) ABSTRACT

A thermal recording material having a thermally color-forming thermal recording layer and a protective layer which are formed on a substrate in this order, wherein the protective layer is a layer obtained by applying an aqueous coating liquid containing a polyvinyl alcohol, a crosslinking agent, a pigment, an Arrhenius acid and a volatile amine onto the thermal recording layer and drying the applied coating liquid.

22 Claims, No Drawings

THERMAL RECORDING MATERIAL AND PROCESS FOR THE PRODUCTION THEREOF

TECHNICAL FIELD

This invention relates to a thermal recording material having a thermally color-forming thermal recording layer and its protective layer, which are formed on a substrate in this order, and a process for production thereof, and specifically to a thermal recording material that is excellent in water resistance of the protective layer and can be produced stably and a process for the production thereof.

BACKGROUND ART

The recording material is generally that which is obtained by forming a thermally color-forming thermal recording layer on a substrate, and when it is heated with a thermal head, a hot pen, a laser beam, etc., an electron-donating compound that is a dye precursor and an electron-accepting compound that is a color developer react instantly with each other to give a recorded image. The above thermal recording material has advantages that a recording is obtained with a relatively simple device, that the maintenance of the device is easy and that no noise is made. Such thermal recording materials are therefore used in broad fields including a measuring meter, a facsimile machine, a printer, a computer terminal, a label printing machine, a ticket or card-issuing machine, and the like.

Further, as these thermal recording materials have come to be used in a variety of fields, there are some use fields where printing is made thereon. In recent years, there is commercially strongly demanded a thermal recording material having strength suitable for printing and having a protective layer that is so excellent in a barrier property as it can keep a printing solvent from developing a color on a ground like ground fogging.

Further, due to recent developments of recording systems in particular, thermal recording materials have come to be used in more severe environments, and in particular when they are used in environments where they are exposed to adhering water, there are strongly demanded thermal recording materials having protective layers excellent in water resistance.

Protective layers having various constitutions are proposed for the purpose of imparting thermal recording materials with surface strength suitable for printing, improving the water resistance thereof and further enabling stable production. As an example of methods therefor, JP 2000-15932 proposes using a diacetone-modified polyvinyl alcohol as a binder and a hydrazine compound as a crosslinking agent in a protective layer and further adding a water-soluble organic amine for inhibiting an increase in the viscosity of a coating liquid and obtaining a highly stable coating liquid. Since, however, the presence of the organic amine also inhibits that reaction between the binder and the crosslinking agent which is necessary for attaining water resistance, the water-resistance-achieving speed of the protective layer is delayed. Further, Japanese Patent No. 3716736 proposes incorporating a diacetone-modified polyvinyl alcohol as a binder into a protective layer and incorporating a hydrazide compound as a crosslinking agent into a thermal recording layer. However, the protective layer is insufficient in attaining water resistance, and the problem is that the viscosity of a coating liquid for a thermal recording layer is increased, that the hydrazide compound inhibits the color development of the thermal recording layer, and that there is caused ground fogging which is the development of a color at the stage of the coating liquid. Further, JP 2002-283717 proposes incorporating into a protective layer a polyvinyl alcohol having a reactive carbonyl group as a binder, a hydrazide compound as a crosslinking agent and a basic filler for improving the stability of a coating liquid for the protective layer. Since, however, the basic filler has no effect on the promotion of a reaction between the polyvinyl alcohol and the crosslinking agent, the water-resistance-achieving speed of the protective layer is slow. Therefore, the present state is that there has not been obtained any thermal recording material that ensures the keeping of coating liquid stability and that exhibits sufficient surface strength, the fast speed of achieving water resistance and high water resistance.

DISCLOSURE OF THE INVENTION

It is an object of this invention to provide a thermal recording material that is excellent in water resistance of a protective layer and that can be stably produced, and a process for the production thereof.

The present inventors have made diligent studies, and as a result have arrived at the inventing of a thermal recording material that can achieve the above object and a process for producing the said thermal recording material.

(1) The thermal recording material of this invention is a thermal recording material having a thermally color-forming thermal recording layer and a protective layer which are formed on a substrate in this order, and has a feature that the above protective layer is obtained by applying an aqueous coating liquid containing a polyvinyl alcohol, a crosslinking agent, a pigment, an Arrhenius acid and a volatile amine onto the thermal recording layer and drying the applied coating liquid. When the Arrhenius acid is incorporated into the protective layer, the crosslinking reaction between the polyvinyl alcohol and the crosslinking agent with time after drying is promoted, and the speed of achieving water resistance is accelerated, whereby the time period that it takes to exhibit practical water resistance can be decreased. Further, when the volatile amine is incorporated into the coating liquid for the protective layer, the coating liquid can be improved in stability, and a coating film that is more uniformly crosslinked is formed, whereby the water resistance can be enhanced.

(2) Further, when the surface pH of a surface having above protective layer formed after drying is adjusted to less than 6, the crosslinking reaction with time is further promoted on the acidic surface, and the speed of achieving water resistance can be accelerated.

(3) Further, when the pH of the above aqueous coating liquid is adjusted to 7 or more, the stability of the coating liquid can be enhanced, and the water resistance can be further enhanced.

(4) Further, when the pH of the above aqueous coating liquid is adjusted to 8 or more, the stability of the coating liquid can be further enhanced.

(5) Further, when the above aqueous coating liquid is prepared, the Arrhenius acid, the volatile amine and the crosslinking agent are added in this order, and the pH after addition of the Arrhenius acid is adjusted to less than 6 and the pH after addition of the volatile amine is adjusted to 7 or more, whereby the speed of achieving water resistance of the protective layer can be accelerated, and the water resistance and the stability of the aqueous coating liquid can be further enhanced.

(6) Further, when diacetone-modified polyvinyl alcohol is used as the above polyvinyl alcohol, the water resistance can be further enhanced.

(7) Further, when the polymerization degree of the above diacetone-modified polyvinyl alcohol is adjusted to 500 or more but less than 4,000, and further when the saponification degree thereof is adjusted to 80% or more but less than 98%, the stability of the above aqueous coating liquid can be further enhanced, and an excellent barrier property can be attained.

(8) Further, a hydrazine compound is used as the above crosslinking agent, the speed of achieving water resistance is further accelerated, and the water resistance can be further enhanced.

(9) When at least one undercoating layer is provided between the above thermal recording layer and substrate, and when organic hollow particles are incorporated into the above undercoating layer, the infiltration of water into the undercoating layer is inhibited in the steps of applying the aqueous coating liquid for a protective layer and drying the applied coating liquid, and water in the protective layer is maintained, whereby a more uniformly crosslinked coating film can be formed, the water resistance is further enhanced, and the sensitivity of forming a color can be improved.

(10) When a generally colorless or light-color dye precursor is incorporated into the above thermal recording layer and when at least one of 3-dibutylamino-6-methyl-7-anilinofluorane, 3-(N-ethyl-N-isoamyl)amino-6-methyl-7-anilinofluorane, 3-dipentylamino-6-methyl-7-anilinofluorane, 3-(N-ethyl-4-methylphenyl)amino-6-methyl-7-anilinofluorane and 3-diethylamino-6-methyl-7-(3-methylphenylamino) fluorine is selected as the above dye precursor, the infiltration of water into the thermal recording layer in the steps of applying an aqueous coating liquid for a protective layer and drying the applied coating liquid is inhibited owing to the hydrophobic nature of the above dye precursor, and water in the protective layer is maintained, whereby a more uniformly crosslinked coating can be formed and the water resistance can be further enhanced.

(11) When kaolin is selected as the pigment in the above protective layer, the flat-plate-like structure of the kaolin inhibits the infiltration of water into the thermal recording layer in the steps of applying the aqueous coating liquid for the protective layer and drying the applied coating liquid, and water in the protective layer is maintained, whereby a more uniformly crosslinked coating film can be formed, the water resistance can be further enhanced, and the barrier property and anti-sticking property can be improved.

(12) Further, when an acryl dispersing agent is used as a dispersing agent for the above pigment, the pigment contained in the aqueous coating liquid for the protective layer is improved in dispersion stability, and the pigment is uniformly distributed in the protective layer formed after coating and drying, whereby the barrier property can be further enhanced. Further, since the pigment present in the surface of the protective layer works as an anti-blocking agent, the water resistance can be further enhanced.

(13) Further, when a lubricant is incorporated into the above protective layer, the lubricant present on the surface of the protective layer formed after coating and drying works as an anti-blocking agent, whereby the water resistance can be further enhanced, and the anti-sticking property can be further enhanced.

(14) Further, whiteness can be improved by incorporating a fluorescent whitener into the above protective layer.

(15) When the above Arrhenius acid is selected from hydroxy acids, the speed of achieving water resistance after drying is maintained, and the decreasing of pH during drying proceeds moderately, whereby a more uniformly crosslinked coating film can be formed and the water resistance can be further enhanced. Further, the hydroxy acid is safe to human bodies and is easily available, so that it is advantageous for industrial production.

(16) Further, when the surface pH of the thermal-recording-layer-forming side of the above substrate is adjusted to less than 7, it is easy to acidify the surface of the above thermal recording material, the speed of achieving water resistance is further accelerated, and further excellent water resistance can be attained.

(17) Further, a back coating layer is formed on the surface opposite to the surface on which the above thermal recording layer is formed.

(18) Further, an adhesive layer is formed on the surface opposite to the surface on which the above thermal recording layer is formed.

(19) Further, a release sheet is provided on the surface opposite to the surface on which the above thermal recording layer is formed.

(20) Further, a magnetic recording layer is formed on the surface opposite to the surface on which the above thermal recording layer is formed.

(21) Further, this invention relates to a process for producing a thermal recording material having a thermally color-forming thermal recording layer and its protective layer formed on a substrate in this order, which comprises applying an aqueous coating liquid that contains a polyvinyl alcohol, a crosslinking agent, a pigment, an Arrhenius acid and a volatile amine and that is prepared at least by adding the Arrhenius acid, the volatile amine and the crosslinking agent in this order on said thermal recording layer and drying the applied coating liquid.

(22) In the above process for producing a thermal recording material, said aqueous coating liquid has a pH of less than 6 after the addition of the Arrhenius acid and has a pH of 7 or more after the addition of the volatile amine.

(23) In the above process for producing a thermal recording material, further, said aqueous coating liquid is applied onto the thermal recording layer with an air knife.

BEST MODE FOR CARRY OUT THE INVENTION

This invention will be further specifically explained. The thermal recording material of this invention has a thermally color-forming thermal recording layer on a substrate and has at least one protective layer on the above thermal recording layer.

The protective layer constituting the thermal recording material of this invention is formed by applying an aqueous coating liquid containing at least a polyvinyl alcohol, a crosslinking agent, a pigment and an Arrhenius acid onto the above thermal recording layer in a state where the aqueous coating liquid is an aqueous coating liquid containing the above Arrhenius acid and volatile amine, and drying the applied coating liquid.

The Arrhenius acid for use in this invention refers to a substance that releases proton in the presence of water. Specifically, it includes hydroxy acids such as lactic acid, citric acid, malic acid, tartaric acid, etc., alkane acids such as formic acid, acetic acid, propionic acid, butyric acid, valeric acid, caproic acid, etc., dibasic acids such as oxalic acid, malonic acid, succinic acid, glutaric acid, adipic acid, maleic acid, fumaric acid, etc., benzoic acids such as benzoic acid, salicylic acid, etc., and inorganic acids such as phosphoric acid, sulfuric acid, sulfurous acid, nitric acid, perchloric acid, hypochlorous acid, hydrochloric acid, etc., and a mixture of two or more of these may be used. When the surface pH of the protective layer is decreased with Arrhenius acid, a nucleophillic crosslinking reaction between a polyvinyl alcohol and a crosslinking agent can be activated, the speed of achieving water resistance is accelerated, and the water resistance can be improved. The Arrhenius acid to be used is not specially limited in this invention, while it is preferably selected from the hydroxy acids since they have volatility and do not easily decompose the polyvinyl alcohol. Those which have high volatility are hard to control after they are added, and those which easily decompose the polyvinyl alcohol impair the improvement of water resistance. When the hydroxy acids that cause a moderate pH decrease during drying are used, the crosslinking reaction with the polyvinyl alcohol slowly proceeds and polyvinyl alcohol molecules are uniformly crosslinked. And, a more uniformly crosslinked coating film is formed and the water resistance is improved. Further, the hydroxy acids have high safety to human bodies and are easily available, and they are advantageous for industrial production.

In the present specification, the speed of achieving water resistance refers to a time period that is taken from the coating of the aqueous coating liquid for a protective layer on the thermal recording layer and its drying to the exhibition of water resistance by the resultant thermal recording material. It is defined that one which takes a short period of time to exhibit water resistance has a high speed of achieving water resistance or is excellent in the speed of achieving water resistance.

The volatile amine for use in this invention refers to an amine that is in a gaseous state at 60° C. under atmospheric pressure. Specifically, it includes ammonia and primary amines substituted with an alkyl group having 1 to 3 carbon atoms such as methylamine, ethylamine, n-propylamine, isopropylamine, etc., and a mixture of two or more of these may be used. When the volatile amine is used, the pH decrease of the aqueous coating liquid by the addition of the above Arrhenius acid can be inhibited, and a reaction between the polyvinyl alcohol and the crosslinking agent in the coating liquid can be inhibited. Therefore, a highly stable coating liquid for a protective layer can be obtained. In the steps of applying the coating liquid for a protective layer onto the thermal recording layer and drying the applied coating liquid, the volatile amine gradually volatilizes, and after drying, it does not inhibit a reaction between the polyvinyl alcohol and the crosslinking agent. As a result, the coating liquid for a protective layer is improved in stability, and the water resistance after the coating and drying can be improved with time. Further, when the crosslinking reaction of the polyvinyl alcohol is caused to proceed slowly, polyvinyl alcohol molecules are uniformly crosslinked, a more uniformly crosslinked coating film is formed, and the water resistance is improved. When the volatile amine is used, the speed of the crosslinking reaction can be adjusted to a proper speed, and the water resistance can be further improved. The volatile amine for use in this invention is not specially limited in this invention, while ammonia is preferred in view of volatility and reactivity with Arrhenius acid. Those which do not easily volatilize or which form a stable reaction product by a reaction with Arrhenius acid continue inhibiting the effect of Arrhenius acid after drying, and impair the water resistance improvement that takes place with time after drying.

The aqueous coating liquid for a protective layer for use in this invention, which contains the Arrhenius acid and the volatile amine, can be prepared by adding the Arrhenius acid and the volatile amine singly or adding a mixture of them, and it can be also prepared by using a neutralization salt or an aqueous solution thereof. The neutralization salt for use in this invention refers to a compound obtained by mixing the volatile amine with the Arrhenius acid. Specifically, it includes ammonium chloride, ammonium sulfate, ammonium oxalate, ammonium phosphate, etc., and a mixture of two or more of these may be used. The volatile amine constituting the neutralization salt volatilizes by heating after it is dissolved in water, while the Arrhenius acid does not volatilize. The aqueous coating liquid prepared from the neutralization salt exhibits an effect similar to that of the aqueous coating liquid prepared by using the volatile amine. Further, the aqueous coating liquid prepared by using the neutralization salt may be adjusted with the volatile amine with respect to its pH.

Since the nucleophillic crosslinking reaction between the polyvinyl alcohol and the crosslinking agent is promoted in an acidic region, the surface pH after the drying of the protective-layer-formed surface is adjusted to an acidic condition or a pH of less than 6, so that the crosslinking reaction after the drying can be effectively promoted, and the water resistance can be further improved with time.

In the present specification, the surface pH of the protective layer is determined by thinly applying a reagent solution for surface pH measurement such as C.R. (cresol red), B.T.B. (bromotymol blue), B.C.P. (bromocresol purple), B.C.G. (bromocresol green) or T.B.P.B. (tetrabromophenol blue) according to an application method of J. TAPP paper pulp testing method No. 6-75 and comparing a hue of the applied coating that is semi-dried with a pH standard color test. An MPC measuring kit supplied by KYORITSU CHEMICAL-CHECK Lab., Corp., etc., are used for actual measurements.

The aqueous coating liquid for a protective layer in this invention preferably has a pH of 7 or more. Since the nucleophillic crosslinking reaction between the polyvinyl alcohol and the crosslinking agent is promoted in an acidic region, the pH of the aqueous coating liquid is adjusted to 7 or more, so that the crosslinking reaction in the coating liquid is inhibited, and there can be obtained a further highly stable aqueous coating liquid for a protective layer. When the pH is less than 7, the crosslinking reaction in the coating liquid is liable to proceed, and the coating liquid is liable to become thick in viscosity or form a gel. When the pH is 8 or more, more preferably, the coating liquid is further improved in stability. Further, when the pH of the aqueous coating liquid for a protective layer is less than 9, more preferably, the ground fogging of the thermal recording layer is inhibited in the coating and drying steps. When the pH is 9 or more, a basic component contained in the coating liquid is liable to cause the thermal recording layer to develop a color in the coating and drying steps, and ground fogging is liable to take place.

The pH of the aqueous coating liquid for a protective layer in the present specification is measured by a glass electrode method described in JIS-Z-8802. A model PH81 personal pH meter supplied by Yokokawa Electric Corporation, etc., is used for actual measurements.

Further, the above aqueous coating liquid for a protective layer is prepared by adding Arrhenius acid, the volatile amine and the crosslinking agent one by one in this order to a mother liquor that is a mixture of the polyvinyl alcohol, the pigment, etc., the pH of the mother liquor after the addition of the Arrhenius acid is adjusted to less than 6, and the pH after the addition of the volatile amine is adjusted to 7 or more, whereby not only the water resistance of the protective layer is further improved, but also the stability of the coating liquid can be further improved.

When the Arrhenius acid, the volatile amine and the crosslinking agent are added in any other order, for example, in the order of the Arrhenius acid, the crosslinking agent and the volatile amine or in the order of the crosslinking agent, the Arrhenius acid and the volatile amine, undesirably, the crosslinking agent and the polyvinyl alcohol are mixed in an acidic state, so that the crosslinking reaction proceeds rapidly, and that the viscosity of the mother liquor/the aqueous coating liquid for a protective layer increases. Further, when they are added in the order of the volatile amine, the Arrhenius acid and the crosslinking agent, in the order of the volatile amine, the crosslinking agent and the Arrhenius acid, or in the order of the crosslinking agent, the volatile amine and the Arrhenius acid, the crosslinking agent and the polyvinyl alcohol are not mixed in an acidic state, so that the viscosity of the mother liquor/the aqueous coating liquid for a protective layer does not rapidly increase, and the stability of the coating liquid hence can be maintained. In operation, however, for adjusting the pH of the aqueous coating liquid for a protective layer to 7 or more, it is preferred to add the volatile amine after the addition of the Arrhenius acid.

Further, when the pH of the mother liquor after the addition of the Arrhenius acid is adjusted to less than 6, preferably less than 5, and when the pH after the addition of the volatile amine is adjusted to 7 or more, preferably 8 or more but less than 9, the stability of the aqueous coating liquid for a protective layer and the water resistance of the protective layer are further improved. When the pH after the addition of the Arrhenius acid is 6 or more, the degree of acidity of the protective layer surface after drying is liable to be insufficient. Further, when the pH after the addition of the volatile amine is less than 7, the crosslinking reaction between the polyvinyl alcohol and the crosslinking agent proceeds in the coating liquid to increase the viscosity of the coating liquid. Further, when the pH after the addition of the volatile amine is 8 or more but less than 9, the coating liquid is further improved in stability, and ground fogging in the steps of applying it onto the thermal recording layer and drying the applied coating liquid is inhibited, which are more preferred.

In this invention, the polyvinyl alcohol used for the protective layer includes non-modified polyvinyl alcohol, carboxy-modified polyvinyl alcohol, silanol-modified polyvinyl alcohol, acetoacetyl-modified polyvinyl alcohol, diacetone-modified polyvinyl alcohol, etc., and these can be used singly or in combination. Of these, the water resistance can be further improved by using the diacetone-modified polyvinyl alcohol.

Further, the polymerization degree of the above polyvinyl alcohol is preferably 500 or more but less than 4,000. When the polymerization degree is adjusted to 500 or more, molecular chains have sufficient lengths, and the holding power that the coating liquid component has owing to the tangling of the molecular chains inhibits the infiltration of coating liquid into the thermal recording layer in the steps of applying the aqueous coating liquid for a protective layer and drying the applied coating liquid, and an excellent coating film can be formed on the thermal recording layer. When it is less than 500, the holding power is insufficient, and the infiltration in the coating and drying steps increases, and it is difficult to form an excellent coating film. Further, when the polymerization degree is adjusted to less than 4,000, the excellent solubility of the polyvinyl alcohol in water can be attained, and the rapid thickening caused by the crosslinking reaction between the polyvinyl alcohol and the crosslinking agent can be suppressed, so that the stability of the coating liquid can be further improved. When it is 4,000 or more, the solubility in water decreases, and a crosslinking reaction causes a rapid thickening, so that the stability of the coating liquid is decreased. Further, when the polymerization degree is 1,000 or more but less than 2,000, a more excellent coating film can be formed on the thermal recording layer, and the stability of the coating liquid is further improved, which are more preferred. The polymerization degree can be measured by a testing method determined in JIS K6726.

Further, the above polyvinyl alcohol preferably has a saponification degree of 80% or more but less than 98%. When the saponification degree is adjusted to less than 98%, the crystallinity of the polyvinyl alcohol is decreased, the volume contraction that a coating film suffers at the step of drying the applied aqueous coating liquid for a protective layer can be inhibited, a coating film having less fine cracks caused by the contraction can be formed, and an excellent barrier property can be attained. When the saponification degree is 98% or more, the crystallinity increases, and the contraction of the coating film in the drying step becomes intense, so that fine cracks are liable to occur, and that the barrier property is liable to be decreased. Further, when the saponification degree is adjusted to 80% or more, the solubility in water is improved, and a coating liquid having high stability can be obtained. When the saponification degree is less than 80%, the solubility in water is liable to decrease, and the stability of the coating liquid is decreased. Further, when the saponification degree is 90% or more but less than 98% or less, the polyvinyl alcohol has more excellent solubility in water, so that the stability of the coating liquid is further improved, that the volume contraction of the coating film in the drying step is suppressed, and that an excellent barrier property can be obtained, which are more preferred. The above saponification degree can be measured by a method determined in JIS K6726.

In this invention, the crosslinking agent for use in the protective layer includes hydrazide compounds, aldehyde compounds such as glyoxal, 2,2-dimethoxyethanal, etc., methylol compounds such as a urea resin, a melamine resin, a phenolic resin, etc., compounds containing an epichlorohydrin residue, typified by a polyamide epichlorohydrin resin, epoxy compounds such as a polyfunctional epoxy resin, etc., isocyanate compounds such as polyisocyanate, a blocked isocyanato compound, etc., oxidizing agents such as persulfate, peroxide, etc., and the like. These may be used singly or in combination. In this invention, in particular, hydrazide compounds are used as a crosslinking agent for the above diacetone-modified polyvinyl alcohol. Specifically, they include adipic acid dihydrazide, isophthalic acid dihydrazide, terephthalic acid dihydrazide, dodecanedioic acid dihydrazide, oxalic acid dihydrazide, moronic acid dihydrazide, succinic acid dihydrazide, glutaric acid dihydrazide, sebacic acid dihydrazide, maleic acid dihydrazide, fumaric acid dihydrazide, itaconic acid dihydrazide, polyacrylic acid hydrazide, etc. These hydrazide compounds undergo a crosslinking reaction with a crosslinkable carbonyl group of the above diacetone-modified polyvinyl alcohol to form a strong bond, and they exhibit high water resistance after the reaction. The hydrazide compound that is to be used is not specially limited in this invention, while adipic acid dihydrazide is more preferred in view of reactivity with the diacetone-modified polyvinyl alcohol. When the surface pH of the protective layer formed from the diacetone-modified polyvinyl alcohol and the adipic acid dihydrazide is adjusted to less than 6, the crosslinking reaction is promoted owing to moisture in air to improve water resistance with time, and further, the crosslinking reaction of them do not cause any discoloration, etc.

The pigment for the protective layer in this invention can be selected from inorganic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate, colloidal silica, etc., and organic pigments such as a melamine resin, a urea-formalin resin, polyethylene, nylon, a styrene plastic pigment, an acrylic plastic pigment, a hydrocarbon plastic pigment, etc. Above all, when kaolin is used, the flat-plate-like structure of kaolin densely covers the thermal recording layer surface and inhibits the infiltration of water into the thermal recording layer in the steps of applying the aqueous coating liquid for the protective layer and drying the applied coating liquid, and it holds water in the protective layer for a long time in the drying step, so that it is ensured that the crosslinking reaction slowly proceeds. The crosslinking reaction of the polyvinyl alcohol proceeds slowly, its molecules are uniformly crosslinked to form a more uniformly crosslinked coating film, so that the water resistance is further improved. Further, kaolin has high compatibility with the diacetone-modified polyvinyl alcohol and serves to give an excellent barrier property and anti-sticking property.

The coating liquid for the protective layer in this invention may contain, as a dispersing agent, an acetylene diol dispersing agent, an acrylic dispersing agent or a polyvinyl alcohol dispersing agent for improving the dispersion stability of the above pigment. When the above dispersing agent is used, the pigment in the coating liquid can be uniformly dispersed, and the localization of the pigment in the coating and drying steps can be inhibited, so that a strain caused by the volume contraction of a coating film in the drying step can be inhibited and the occurrence of fine cracks are reduced. The barrier property can be hence further improved. Further, since the pigment remaining on the surface of the protective layer formed after the coating and drying works as an anti-blocking agent, the water resistance can be improved. The dispersing agent to be used is not specially limited as far as the effect of this invention is concerned, while an acrylic dispersing agent is more preferred as a dispersing agent for the above kaolin since it has good compatibility and can give a more excellent barrier property.

The protective layer in this invention may contain a lubricant such as a higher fatty acid metal salt, a higher fatty acid amide, a paraffin, a polyolefin, polyethylene oxide, castor wax, etc. When the above lubricant is used, the lubricant present on the surface of the protective layer formed after the coating and drying works as an anti-blocking agent, so that the water resistance can be improved. Further, the anti-sticking property can be also improved.

The protective layer in this invention may contain a fluorescent whitener, and diaminostilbene compounds are preferred. Of these, a triazinylaminostilbene compound gives an excellent whiteness when used.

The amounts of the polyvinyl alcohol, crosslinking agent, pigment, Arrhenius acid and volatile amine for use in the protective layer of this invention are not specially limited so long as they are in the ranges in which the effect of this invention is produced, while the following ranges are preferably employed. On the basis of the total solid content of the protective layer, the amount of the polyvinyl alcohol is 40 to 90 mass %, and that of the pigment is 5 to 50 mass %. The amount of the crosslinking agent based on the polyvinyl alcohol is 0.5 to 30 mass %. The amounts of the Arrhenius acid and the volatile amine are determined depending upon pH, while the amount of each of these based on the total solid content of the aqueous coating liquid for the protective layer is preferably in the range of 0.00001 to 20 mass %.

Further, the protective layer may contain the dispersing agent, lubricant and fluorescent whitener and may further contain a benzophenone- or benzotriazole-containing ultraviolet absorbent, a surfactant including an anionic and nonionic polymers as a lubricant, an anti-foaming agent, etc., as required. The absolute dry coating amount of the protective layer is preferably 0.2 to 10 g/m$^2$, more preferably 1 to 5 g/m$^2$.

The electron-donating compound that is generally colorless or light-color dye precursor contained in the thermal recording layer constituting the thermal recording material of this invention is typified by those which are generally used in pressure-sensitive recording materials and thermal recording materials.

Specific examples of the dye precursor include the following dye precursors.

(1) Triarylmethane compounds: 3,3-bis(p-dimethylaminophenyl)-6-dimethylaminophthalide (crystal violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, 3-p-dimethylaminophenyl-3-(1-methylpyrrol-2-yl)-6-dimethylaminophthalide, etc.

(2) Diphenylmethane compounds: 4,4-bis(dimethylaminophenyl)benzhydrylbenzyl ether, N-chlorophenyl leucoauramine, N-2,4,5-trichlorophenyl leucoauramine, etc.

(3) Xanthene compounds: rhodamine B anilinolactam, rhodamine B-p-chloroanilinolactam, 3-diethylamino-7-dibenzylaminofluorane, 3-diethylamino-7-octylaminofluorane, 3-diethylamino-7-phenylfluorane, 3-diethylamino-7-chlorofluorane, 3-diethylamino-6-chloro-7-methylfluorane, 3-diethylamino-6-methyl-7-(3-methylphenylamino)fluorane, 3-diethylamino-7-(3,4-dichloroanilino)fluorane, 3-dibutylamino-7-(2-chloroanilino)fluorane, 3-diethylamino-7-(2-chloroanilino)fluorane, 3-diethylamino-6-methyl-7-anilinofluorane, 3-dibutylamino-6-methyl-7-anilinofluorane, 3-dipentylamino-6-methyl-7-anilinofluorane, 3-(N-ethyl-N-tolyl)amino-6-methyl-7-anilinofluorane, 3-piperidino-6-methyl-7-anilinofluorane, 3-(N-ethyl-N-tolyl)amino-6-methyl-7-phenetylfluorane, 3-diethylamino-7-(4-nitroanilino)fluorane, 3-dibutylamino-6-methyl-7-anilinofluorane, 3-(N-methyl-N-propyl)amino-6-methyl-7-anilinofluorane, 3-(N-ethyl-N-isoamyl)amino-6-methyl-7-anilinofluorane, 3-(N-methyl-N-cyclohexyl)amino-6-methyl-7-anilinofluorane, 3-(N-ethyl-N-tetrahydrofurfuryl)amino-6-methyl-7-anilinofluorane, 3-(N-ethyl-4-methylphenyl)amino-6-methyl-7-anilinofluorane, 3-diethylamino-6-methyl-7-(3-trifluoromethylanilino)fluorane, etc.

(4) Thiazine compounds: benzoyl leucomethylene blue, p-nitrobenzoyl leucomethylene blue, etc.

(5) Spiro compounds: 3-methylspirodinaphthopyran, 3-ethylspirodinaphthopyran, 3,3'-dichlorospirodinaphthopyran, 3-benzylspirodinaphthopyran, 3-methylnaphtho-(3-methoxybenzo)spiropyran, 3-propylspirobenzopyran, etc.

These dye precursors may be used singly or as a mixture of two or more of them.

Further, when the above dye precursor that is used is at least one selected from 3-dibutylamino-6-methyl-7-anilinofluorane, 3-(N-ethyl-N-isoamyl)amino-6-methyl-7-anilinofluorane, 3-dipentylamino-6-methyl-7-anilinofluorane, 3-(N-ethyl-4-methylphenyl)amino-6-methyl-7-anilinofluorane and 3-diethylamino-6-methyl-7-(3-methylphenylamino) fluorane, the hydrophobic nature of the above compound inhibits the infiltration of water into the thermal recording layer in the steps of coating the aqueous coating liquid for the protective layer and drying the applied coating liquid and maintains water in the protective layer for a long time in the drying step, so that it can be ensured that the crosslinking reaction proceeds slowly. When the crosslinking reaction of the polyvinyl alcohol proceeds slowly, molecules of the polyvinyl alcohol are uniformly crosslinked, and a more uniformly crosslinked coating film is formed, so that the water resistance can be further improved.

The thermal recording layer constituting the thermal recording material of this invention is obtained by mixing aqueous dispersions of finely pulverized color-forming components with resins, etc., coating the mixture on a substrate and drying the applied mixture.

The thermal recording layer may contain, as a pigment, in organic pigments such as diatomite, talc, kaolin, calcined kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate, colloidal silica, etc., and organic pigments such as a melamine resin, a urea-formalin resin, polyethylene, nylon, a styrene plastic pigment, an acrylic plastic pigment, a hydrocarbon plastic pigment, etc.

For the purpose of improving an anti-sticking property, the thermal recording layer may contain a lubricant. Specifically, it is preferably selected from those lubricants which are described in the explanation of the protective layer.

For improving light resistance, etc., the thermal recording layer contains a benzophenone- or benzotriazole-containing ultraviolet absorbent, a surfactant including anionic and nonionic polymer surfactants as a dispersing and wetting agent, and, further, a fluorescent dye, an anti-foaming agent, etc., as required. For obtaining sufficient thermal response, the coating amount for the thermal recording layer, normally as an absolute dry coating amount of the dye precursor, is preferably 0.05 to 2.0 g/m$^2$, more preferably 0.1 to 1.0 g/m$^2$.

The electron-accepting compound that constitutes the thermal recording material of this invention and that is a color developer contained in the thermal recording layer is typified by acidic substances that are generally used in pressure-sensitive recording materials or thermal recording materials, while it shall not be limited thereto. For example, it includes phenol derivatives, aromatic carboxylic acid derivatives, N,N-diarylthiourea derivatives, arylsulfonylurea derivatives, polyvalent metal salts such as zinc salt of an organic compound, benzenesulfoneamide derivatives, ureaurethane compounds, etc.

Specific examples of the electron-accepting compound contained in the thermal recording layer will be described below, while it shall not be necessarily limited thereto.

4-Hydroxy-4'-isopropoxydiphenylsulfone, 4-hydroxy-4'-n-propoxydiphenylsulfone, 4,4'-dihydroxydiphenylsulfone, 2,4'-dihydroxydiphenylsulfone, 4-hydroxydiphenylsulfone, 4-hydroxy-4'-methyldiphenylsulfone, 4-hydroxy-4'-methoxydiphenylsulfone, 4-hydroxy-4'-ethoxyphenylsulfone, 4-hydroxy-4'-n-butoxydiphenylsulfone, 4-hydroxy-4'-benzyloxydiphenylsulfone, bis(4-hydroxyphenyl)sulfone monoallyl ether, bis(3-allyl-4-hydroxyphenyl)sulfone, bis(3,5-dibromo-4-hydroxyphenyl)sulfone, bis(3,5-dichloro-4-hydroxyphenyl)sulfone, 3,4-dihydroxydiphenylsulfone, 3,4-dihydroxy-4'-methyldiphenylsulfone, 3,4,4'-trihydroxydiphenylsulfone, 4,4'-[oxybis(ethyleneoxy-p-phenylenesulfonyl)]diphenol, 3,4,3',4'-tetrahydroxydiphenylsulfone, 2,3,4-trihydroxydiphenylsulfone, 3-phenylsulfonyl-4-hydroxydiphenylsulfone, 2,4-bis(phenylsulfonyl)phenol, 4-phenylphenol, 4-hydroxyacetophenone, 1,1-bis(4-hydroxyphenyl)propane, 1,1-bis(4-hydroxyphenyl)pentane, 1,1-bis(4-hydroxyphenyl)hexane, 1,1-bis(4-hydroxyphenyl) cyclohexane, 2,2-bis(4-hydroxyphenyl)propane, 2,2-bis(4-hydroxyphenyl)hexane, 1,1-bis(4-hydroxyphenyl)-2-ethylhexane, 2,2-bis(3-chloro-4-hydroxyphenyl)propane, 1,1-bis (4-hydroxyphenyl)-1-phenylethane, 1,3-bis[1-(4-hydroxyphenyl)-1-methylethyl]benzene, 1,3-bis[1-(3,4-dihydroxyphenyl)-1-methylethyl]benzene, 1,4-bis[1-(4-hydroxyphenyl)-1-methylethyl]benzene, 4,4'-hydroxydiphenyl ether, 3,3-dichloro-4,4'-dihydroxydiphenyl sulfide, bis(2-hydroxynaphthyl)methane, methyl 2,2-bis(4-hydroxyphenyl)acetate, butyl 2,2-bis(4-hydroxyphenyl)acetate, 4,4-thiobis(2-tert-butyl-5-methylphenol), dimethyl 4-hydroxyphthalate, benzyl 4-hydroxybenzoate, methyl 4-hydroxybezonate, benzyl gallate, stearyl gallate, pentaerythritoltetra(4-hydroxybenzoate)ester, pentaerythritoltri(4-hydroxybenzoate)ester, a dehydration condensate of 2,2-bis(hydroxymethyl)-1,3-propanediol polycondensate and 4-hydroxybenzoic acid, N,N'-diphenylthiourea, 4,4'-bis[3-(4-methylphenylsulfonyl)ureido]diphenyl methane, N-(4-methylphenylsulfonyl)-N'-phenylurea, N-(benzylsulfonyl)-N'-[3-(4-toluenesulfonyloxy)phenyl]urea, N-(4-toluenesulfonyl)-N-[3'-(4-toluenesulfonyloxy)phenyl]urea, N-butyl-4-(3-(p-toluenesulfonyl)ureido)benzoate, a ureaurethane compound, salicylanilide, 5-chlorosalicylanilide, salicylic acid, 3,5-di-tert-butylsalicylic acid, 3,5-bis(α-methyl benzyl)salicylic acid, 4-[2'-(4-methoxyphenoxy)ethyloxy]salicylic acid, 3-(octyloxycarbonylamino)salicylic acid or metal salts (e.g., zinc salt) of these salicylic acid derivatives, N-(4-hydroxyphenyl)-4-toluenesulfoneamide, N-(2-hydroxyphenyl)-4-toluenesulfoneamide, N-phenyl-4-hydroxybenzenesulfoneamide, The thermal recording material of this invention may contain a thermally meltable substance for improving the thermal response thereof. In this case, a substance having a melting point of 60 to 180° C. is preferred, and in particular a substance having a melting point of 80 to 140° C. is more preferably used.

Specifically, it includes known thermally meltable substances such as stearic acid amide, N-hydroxymethylstearic acid amide, N-stearylstearic acid amide, ethylenebisstearic acid amide, methylenebisstearic acid amide, methylolstearic acid amide, N-stearylurea, benzyl-2-naphthyl ether, m-terphenyl, 4-benzylbiphenyl, 2,2'-bis(4-methoxyphenoxy)diethyl ether, α,α'-diphenoxy-o-xylene, bis(4-methoxyphenyl) ether, diphenyl adipate, dibenzyl oxalate, di(4-methylbenzyl) oxalate, bis(4-chlorobenzyl)oxalate, dimethyl terephthalate, dibenzyl terephthalate, phenyl benzenesulfonate, bis(4-allyloxyphenyl)sulfone, 1,2-bis(3-methylphenoxy)ethane, 1,2-diphenoxyethane, 4-acetylacetophenone, acetoacetic acid anilides, fatty acid anilides, etc. It is preferred to use a higher fatty acid amide since it works as a lubricant.

These compounds may be used singly or in combination of two or more of them. For obtaining sufficient thermal response, preferably, the thermally meltable substance accounts for 5 to 50 mass % based on the total solid content of the thermal recording layer.

The binder for use in the thermal recording layer can be selected from various binders that are used for normal coating.

Specifically, it includes water-soluble binders such as starches, hydroxymethyl cellulose, methyl cellulose, ethyl cellulose, carboxymethyl cellulose, gelatin, casein, polyvinyl alcohol, modified polyvinyl alcohol, sodium alginate, polyvinyl pyrrolidone, polyacrylamide, an acrylamide/acrylic ester copolymer, an acrylamide/acrylic ester/methacrylic acid terpolymer, an alkali salt of polyacrylic acid, an alkali salt of polymaleic acid, an alkali salt of a styrene/maleic anhydride copolymer, an alkali salt of an ethylene/maleic anhydride copolymer, an alkali salt of an isobutylene/maleic anhydride copolymer, etc., and water-dispersible binders such as a styrene/butadiene copolymer, an acrylonitrile/butadiene copolymer, a methyl acrylate/butadiene copolymer, an acrylonitrile/butadiene/styrene terpolymer, polyvinyl acetate, a vinyl acetate/acrylic ester copolymer, an ethylene/vinyl acetate copolymer, polyacrylic ester, a styrene/acrylic ester copolymer, polyurethane, etc. However, the binder shall not be limited to these.

In the thermal recording material of this invention, at least one undercoating layer formed of a pigment, a resin or the like may be provided between the substrate and the thermal recording layer as required. When the thermal recording material of this invention has an undercoating layer, the absolute dry coating amount of the undercoating layer is preferably 1 to 30 g/m$^2$, more preferably 3 to 20 g/m$^2$.

As a pigment for use in the undercoating layer, calcined kaolin is generally used. Besides this, the pigment is selected from inorganic pigments such as diatomite, talc, kaolin, heavy calcium carbonate, light calcium carbonate, magnesium carbonate, zinc oxide, aluminum oxide, aluminum hydroxide, magnesium hydroxide, titanium dioxide, barium sulfate, zinc sulfate, amorphous silica, amorphous calcium silicate, colloidal silica, etc., organic pigments such as a melamine resin, a urea-formalin resin, polyethylene, nylon, a styrene plastic pigment, an acrylic plastic pigment, a hydrocarbon plastic pigment, etc., and an organic hollow particulate pigment. These may be used singly or in combination. Above all, an organic hollow particulate pigment is used, the porosity of the undercoating layer is increased thereby to increase the heat insulating property, and a high color sensitivity can be obtained. And, the specific surface area per volume is decreased, so that, the infiltration of water into the undercoating layer is inhibited in the steps of coating the aqueous coating liquid for the protective layer and drying the applied coating liquid, that water in the protective layer can be held for a long time in the drying step to proceed with the crosslinking reaction slowly. When the crosslinking reaction of the polyvinyl alcohol proceeds slowly, molecules of the polyvinyl alcohol are uniformly crosslinked to form a more uniformly crosslinked coating film, so that the water resistance can be further improved.

The above organic hollow particulate pigment for use in this invention shall not specially limited, while it includes homopolymers obtained from monomers such as vinyl chloride, vinylidene chloride, vinyl acetate, styrene, methyl acrylate, ethyl acrylate, butyl acrylate, acrylonitrile, methyl methacrylate, ethyl methacrylate, butyl methacrylate, methacrylonitrile, etc., as a main component or copolymers obtained from two or more monomers of these. As these organic hollow particles, there can be used resin particles having an average particle diameter, measured by a particle size distribution measurement method according to a laser diffraction method, of 0.1 to 5.0 μm, more preferably 0.5 to 2.0 μm. The hollowness ratio of the organic hollow particles (a volume ratio of a space portion to the total volume of a resin portion and the space portion of the particles) is 20 to 90%, more preferably 40 to 90%. The organic hollow particles are commercially available as Ropaque series from Rohm and Haas Japan K.K. or SX series from JSR Corporation. Specifically, there can be employed Ropaque HP-91 (average particle diameter 1.0 μm, hollowness ratio 51%), Ropaque OP-62 (ditto 0.4 μm, ditto 33%), Ropaque OP-84J (ditto 0.55 μm, ditto 20%), SX8782 (A) (ditto 1.1 μm, ditto 55%), SX8782(D) (ditto 1.0 μm, ditto 51%), SX866(B) (ditto 0.3 μm, ditto 30%), etc.

The binder for the undercoating layer in this invention can be selected from various binders that are used for general coatings like the thermal recording layer. Specific examples thereof are as explained with respect to the thermal recording layer.

As a substrate for use in the thermal recording material of this invention, paper is mainly used. In addition to paper, it can be selected from various woven fabrics, non-woven fabrics, a synthetic resin film, a synthetic resin laminated sheet, a synthetic paper, a metal foil, a vapor deposition sheet, a composite sheet of a combination of two or more of these which are laminated, etc., as required depending upon purposes.

The substrate for use in the thermal recording material of this invention is not specially limited, while it is preferred to use a substrate whose surface on the side where the thermal recording layer is formed has a pH of less than 7. When a substrate whose surface has a pH of less than 7 is used, the effect of Arrhenius acid is not easily inhibited when the protective layer containing the Arrhenius acid is formed, the surface pH of the protective layer is easily adjusted to less than 6, and the speed of achieving the water resistance can be further accelerated.

In this invention, a back coating layer may be formed as required on that surface of the substrate which is opposite to the surface where the thermal recording layer and the protective layer are formed. A known back coating layer may be formed, and it is not specially limited.

In this invention, an adhesive layer may be formed as required on that surface of the substrate which is opposite to the surface where the thermal recording layer and the protective layer are formed. A known adhesive layer may be formed, and it is not specially limited.

In this invention, a release sheet may be formed as required on that surface of the substrate which is opposite to the surface where the thermal recording layer and the protective layer are formed. A known release sheet may be formed, and it is not specially limited.

In this invention, a magnetic recording layer may be formed as required on that surface of the substrate which is opposite to the surface where the thermal recording layer and the protective layer are formed. A magnetic recording layer may be formed, and it is not specially limited.

The thermal recording material of this invention has been explained hereinabove, and a process for producing a thermal recording material, provided by this invention, will be explained below.

The process for producing a thermal recording material, provided by this invention, is a process which comprises forming a thermally color-forming thermal recording layer and its protective layer in this order on a substrate, and has a feature in that the above protective layer is formed by coating an aqueous coating liquid that contains a polyvinyl alcohol, a crosslinking agent, a pigment, an Arrhenius acid and a volatile amine and that is prepared by at least adding the Arrhenius acid, the volatile amine and the crosslinking agent in this order on the above thermal recording layer and drying the applied coating liquid.

The process for producing a thermal recording material, provided by this invention, has a feature in the use, as an aqueous coating liquid for the protective layer, of an aqueous coating liquid prepared by adding an Arrhenius acid, a volatile amine and a crosslinking agent in this order to a mother liquor obtained by mixing a polyvinyl alcohol, a pigment, etc., and the reason for limiting the adding order of the above three components as described above is that since the crosslinking reaction of the polyvinyl alcohol in the aqueous coating liquid is inhibited, the aqueous coating liquid excellent in stability can be obtained.

The above aqueous coating liquid preferably has a pH of less than 6 after the addition of the Arrhenius acid and a pH of 7 or more after the addition of the volatile amine. The reason therefor is that not only the water resistance of the protective layer can be enhanced but also the stability of the coating liquid can be further improved.

In the process for producing a thermal recording material, provided by this invention, the thermal recording layer and the protective layer are formed as essential layers, and the back coating layer and the undercoating layer are formed as optional layers. The method for forming each of these layers is not specially limited, and they can be formed according to conventionally known methods. As a specific example, a coating liquid is coated by a method such as film press coating, air knife coating, rod blade coating, bar coating, blade coating, gravure coating, curtain coating, E bar coating, etc., and an applied coating liquid is dried, whereby each layer can be formed. Alternatively, these layers may be formed with various printing machines according to lithographic, letter press, flexographic, gravure, screen, hot-melt, etc., printing methods. Of these, the air knife coating that is less influenced by the viscosity of a coating liquid, etc., is more preferred for forming the protective layer.

Super calendering is carried out as required after the coating for the undercoating layer, the coating for the thermal recording layer or the coating for the protective layer, whereby an image quality can be improved.

EXAMPLES

This invention will be more specifically explained below with reference to Examples, while this invention shall not be limited thereto. In the following Examples and Comparative Examples, "part" and "%" are based on weight, and a coating amount refers to an absolute dry coating amount.

Example 1

(1) Preparation of Coating Liquid for Undercoating Layer

A composition containing 100 parts of calcined kaolin [Ansilex: supplied by BASF], 34 parts of a 50% styrene/butadiene latex, 48 parts of a 13% starch aqueous solution and 200 parts of water was mixed and stirred to prepare a coating liquid for an undercoating layer.

(2) Preparation of Coating Liquid for Thermal Recording Layer

<Dispersion A>

20 Parts of 3-dibutylamino-6-methyl-7-anilinofluorane was dispersed in a mixture of 20 parts of a 10% sulfone-group-modified polyvinyl alcohol aqueous solution with 60 parts of water, and the resultant dispersion was pulverized with a bead mill until it had a volume average particle diameter of 1 μm, to prepare a dispersion A.

<Dispersion B>

20 Parts of N-(4-toluenesulfonyl)-N'-[3-(4-toluenesulfonyloxy)phenyl]urea was dispersed in a mixture of 20 parts of a 10% sulfone-group-modified polyvinyl alcohol with 60 parts of water, and the resultant dispersion was pulverized with a bead mill until it had a volume average particle diameter of 1 μm, to prepare a dispersion B.

<Dispersion C>

20 Parts of benzyl-2-naphthyl ether was dispersed in a mixture of 20 parts of a 10% sulfone-group-modified polyvinyl alcohol with 60 parts of water, and the resultant dispersion was pulverized with a bead mill until it had a volume average particle diameter of 1 μm, to prepare a dispersion C.

The above dispersions were mixed in the following amounts and fully stirred to prepare a coating liquid for a thermal recording layer.

| | |
|---|---|
| Dispersion A | 100 parts |
| Dispersion B | 100 parts |
| Dispersion C | 100 parts |
| 30% Light calcium carbonate aqueous solution | 50 parts |
| 10% Carboxy-modified polyvinyl alcohol aqueous solution | 130 parts |
| 40% Zinc stearate aqueous dispersion | 7 parts |
| Water | 60 parts |

(3) Preparation of Coating Liquid for Protective Layer

First, 1 part of a 50% lactic acid aqueous solution, 0.3 part of a 25% ammonia aqueous solution and 98 parts of water were mixed, to prepare an aqueous solution 1 containing a mixture of Arrhenius acid with a volatile amine. Then, the following materials in the following amounts were added and mixed in the following order, and the mixture was stirred for 2 hours to prepare an aqueous coating liquid for a protective layer. The aqueous coating liquid for a protective layer had a pH of 6.8.

| | |
|---|---|
| 10% Complete-saponification polyvinyl alcohol [supplied by Nippon Synthetic Chemical Co., Ltd.: NM-11, polymerization degree 1,100, saponification degree 99.5%] | 150 parts |
| 30% Aluminum hydroxide [Martifin OL-107, supplied by Martinswerk] aqueous dispersion | 13 parts |
| 40% Glyoxazole aqueous solution | 2 parts |
| 15% Polyamide epichlorohydrin aqueous solution | 6 parts |
| The aqueous solution 1 | 99.3 parts |

(4) Making of Thermal Recording Material

The coating liquid for an undercoating layer and the coating liquid for a thermal recording layer were consecutively coated on neutral woodfree paper having a basis weight of 50 g/m$^2$ such that the coating amount of the coating liquid for an undercoating layer was 9 g/m$^2$ and that the coating amount of a dye precursor was 0.5 g/m$^2$, to give an undercoating layer and a thermal recording layer. Then, the aqueous coating liquid for a protective layer was bar-coated on the thermal recording layer such that the coating amount thereof was 2 g/m$^2$, and the applied coating liquid was dried, followed by calendering, to make a thermal recording material. The surface pH of the protective layer surface of the thus-obtained thermal recording material was 6.2.

Example 2

A thermal recording material was made in the same manner as in Example 1 except that an aqueous coating liquid for a protective layer in the (3) preparation of an aqueous coating liquid for a protective layer in Example 1 was prepared by the following procedures. First, 3 parts of a 50% lactic acid aqueous solution, 0.9 part of a 25% ammonia aqueous solution and 95 parts of water were mixed, to prepare an aqueous solution 2 containing a mixture of Arrhenius acid with a volatile amine. Then, the following materials in the following amounts were added and mixed in the following order, and the mixture was stirred for 2 hours to prepare an aqueous coating liquid for a protective layer. The aqueous coating liquid for a protective layer had a pH of 6.8, and the surface pH of the protective layer surface of the thus-obtained thermal recording material was 5.6.

| | |
|---|---|
| 10% NM-11 aqueous solution | 150 parts |
| 30% Martifin OL-107 aqueous dispersion | 13 parts |
| 40% Glyoxazole aqueous solution | 2 parts |
| 15% Polyamide epichlorohydrin aqueous solution | 6 parts |
| The aqueous solution 2 | 98.9 parts |

Example 3

A thermal recording material was made in the same manner as in Example 1 except that an aqueous coating liquid for a protective layer in the (3) preparation of an aqueous coating liquid for a protective layer in Example 1 was prepared by the following procedures. First, 3 parts of a 50% lactic acid aqueous solution, 1.1 parts of a 25% ammonia aqueous solution and 95 parts of water were mixed, to prepare an aqueous solution 3 containing a mixture of Arrhenius acid with a volatile amine. Then, the following materials in the following amounts were added and mixed in the following order, and the mixture was stirred for 2 hours to prepare an aqueous coating liquid for a protective layer. The aqueous coating liquid for a protective layer had a pH of 7.3, and the surface pH of the protective layer surface of the thus-obtained thermal recording material was 5.6.

| | |
|---|---|
| 10% NM-11 aqueous solution | 150 parts |
| 30% Martifin OL-107 aqueous dispersion | 13 parts |
| 40% Glyoxazole aqueous solution | 2 parts |
| 15% Polyamide epichlorohydrin aqueous solution | 6 parts |
| The aqueous solution 3 | 99.1 parts |

Example 4

A thermal recording material was made in the same manner as in Example 1 except that an aqueous coating liquid for a protective layer in the (3) preparation of an aqueous coating liquid for a protective layer in Example 1 was prepared by the following procedures. First, 3 parts of a 50% lactic acid aqueous solution, 1.3 parts of a 25% ammonia aqueous solution and 95 parts of water were mixed, to prepare an aqueous solution 4 containing a mixture of Arrhenius acid with a volatile amine. Then, the following materials in the following amounts were added and mixed in the following order, and the mixture was stirred for 2 hours to prepare an aqueous coating liquid for a protective layer. The aqueous coating liquid for a protective layer had a pH of 8.3, and the surface pH of the protective layer surface of the thus-obtained thermal recording material was 5.7.

| | |
|---|---|
| 10% NM-11 aqueous solution | 150 parts |
| 30% Martifin OL-107 aqueous dispersion | 13 parts |
| 40% Glyoxazole aqueous solution | 2 parts |
| 15% Polyamide epichlorohydrin aqueous solution | 6 parts |
| The aqueous solution 4 | 99.3 parts |

Example 5

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The mixture after the addition of the lactic acid aqueous solution had a pH of 3.7, and the mixture after the addition of the ammonia aqueous solution had a pH of 8.6. Further, the aqueous coating liquid for a protective layer had a pH of 8.3, and the surface pH of the protective layer surface of the thus-obtained thermal recording material was 5.7.

| | |
|---|---|
| 10% NM-11 aqueous solution | 150 parts |
| 30% Martifin OL-107 aqueous dispersion | 13 parts |
| 50% Lactic acid aqueous solution | 3 parts |
| 25% Ammonia aqueous solution | 1.3 parts |
| 40% Glyoxazole aqueous solution | 2 parts |
| 15% Polyamide epichlorohydrin aqueous solution | 6 parts |

Example 6

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.3, and the surface pH of the protective layer surface of the thus-obtained thermal recording material was 5.6.

| | |
|---|---|
| 10% NM-11 aqueous solution | 150 parts |
| 30% Martifin OL-107 aqueous dispersion | 13 parts |
| Water | 95 parts |
| 40% Glyoxazole aqueous solution | 2 parts |
| 15% Polyamide epichlorohydrin aqueous solution | 6 parts |
| 50% Lactic acid aqueous solution | 3 parts |
| 25% Ammonia aqueous solution | 1.3 parts |

Example 7

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The mixture after the addition of the lactic acid aqueous solution had a pH of 3.7, and the mixture after the addition of the ammonia aqueous solution had a pH of 8.6. Further, the aqueous coating liquid for a protective layer had a pH of 8.5, and the surface pH of the protective layer surface of the thus-obtained thermal recording material was 5.8.

| | |
|---|---|
| 10% Diacetone-modified polyvinyl alcohol [DF-17, supplied by JAPAN VAM & POVAL CO., LTD., polymerization degree 1,700, saponification degree 98.5%] aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

Example 8

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.5, and the surface pH of the protective layer surface of the thus-obtained thermal recording material was 5.8.

| | |
|---|---|
| 10% Diacetone-modified polyvinyl alcohol [DF-10, supplied by JAPAN VAM & POVAL CO., LTD., polymerization degree 1,000, saponification degree 98.5%] aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

Example 9

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.5, and the surface pH of the protective layer surface of the thus-obtained thermal recording material was 5.8.

| | |
|---|---|
| 10% Diacetone-modified polyvinyl alcohol [DF-30, supplied by JAPAN VAM & POVAL CO., LTD., polymerization degree 3,000, saponification degree 98.5%] aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

Example 10

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.5, and the surface pH of the protective layer surface of the thus-obtained thermal recording material was 5.8.

| | |
|---|---|
| 10% Diacetone-modified polyvinyl alcohol [DM-20, supplied by JAPAN VAM & POVAL CO., LTD., polymerization degree 2,000, saponification degree 96.5%] aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

Example 11

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.5, and the surface pH of the protective layer surface of the thus-obtained thermal recording material was 5.8.

| | |
|---|---|
| 10% Diacetone-modified polyvinyl alcohol [DM-17 supplied by JAPAN VAM & POVAL CO., LTD., polymerization degree 1,700, saponification degree 96.5%] aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

Example 12

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.4, and the surface pH of the protective layer surface of the thus-obtained thermal recording material was 5.8.

| | |
|---|---|
| 10% DM-17 aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Adipic acid dihydrazide aqueous solution | 18 parts |

Example 13

A thermal recording material was made in the same manner as in Example 1 except that an undercoating layer in the (1) preparation of an undercoating layer in Example 1 was prepared by using 72.5 parts of Ansilex, 100 parts of a 27.5% hollow particles dispersion [AF1055: supplied by Rhom & Haas Company] and 127.5 parts of water in place of 100 parts of Ansilex and 200 parts of water and further that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.4, and the surface pH of the protective layer surface of the thus-obtained thermal recording material was 5.8.

| | |
|---|---|
| 10% DF-17 aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Adipic acid dihydrazide aqueous solution | 18 parts |

Example 14

A thermal recording material was made in the same manner as in Example 1 except that a dispersion A in <Dispersion A> of the (2) preparation of a coating liquid for a thermal recording layer in Example 1 was prepared by using 20 parts of 3-(N-ethyl-N-isoamyl)amino-6-methyl-7-anilinofluorane in place of 20 parts of 3-dibutylamino-6-methyl-7-anilinofluorane and further that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.4, and the surface pH of the protective layer surface of the thus-obtained thermal recording material was 5.8.

| | |
|---|---|
| 10% DF-17 aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Adipic acid dihydrazide aqueous solution | 18 parts |

Example 15

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.3, and the surface pH of the protective layer surface of the thus-obtained thermal recording material was 5.6.

| | |
|---|---|
| 10% DF-17 aqueous solution | 150 parts |
| 20% Kaolin [HG-90: supplied by Huber] aqueous dispersion | 20 parts |
| Water | 78 parts |
| 50% Lactic acid aqueous solution | 3 parts |
| 25% Ammonia aqueous solution | 1.3 parts |
| 8% Adipic acid dihydrazide aqueous solution | 18 parts |

Example 16

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.3, and the surface pH of the protective layer surface of the thus-obtained thermal recording material was 5.6.

| | |
|---|---|
| 10% DF-17 aqueous solution | 150 parts |
| 20% HG-90 aqueous dispersion | 20 parts |
| 40% Acrylic dispersing agent [DISPEX A40: supplied by Ciba Specialty Chemicals] | 0.03 part |
| Water | 78 parts |
| 50% Lactic acid aqueous solution | 3 parts |
| 25% Ammonia aqueous solution | 1.3 parts |
| 8% Adipic acid dihydrazide aqueous solution | 18 parts |

Example 17

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.3, and the surface pH of the protective layer surface of the thus-obtained thermal recording material was 5.6.

| | |
|---|---|
| 10% DF-17 aqueous solution | 150 parts |
| 20% HG-90 aqueous dispersion | 20 parts |
| DISPEX A40 | 0.03 part |
| 30% Zinc stearate aqueous dispersion | 7 parts |
| Water | 71 parts |
| 50% Lactic acid aqueous solution | 3 parts |
| 25% Ammonia aqueous solution | 1.3 parts |
| 8% Adipic acid dihydrazide aqueous solution | 18 parts |

Example 18

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.3, and the surface pH of the protective layer surface of the thus-obtained thermal recording material was 5.6.

| | |
|---|---|
| 10% DF-17 aqueous solution | 150 parts |
| 20% HG-90 aqueous dispersion | 20 parts |
| Fluorescent whitener [Tinopal MSP: supplied by Ciba Specialty Chemicals] | 0.2 part |
| Water | 77.8 parts |
| 50% Lactic acid aqueous solution | 3 parts |
| 25% Ammonia aqueous solution | 1.3 parts |
| 8% Adipic acid dihydrazide aqueous solution | 18 parts |

Example 19

A thermal recording material was made in the same manner as in Example 1 except that an undercoating layer in the (1) preparation of an undercoating layer in Example 1 was prepared by using 72.5 parts of Ansilex, 100 parts of AF1055 and 127.5 parts of water in place of 100 parts of Ansilex and 200 parts of water and further that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.3, and the surface pH of the protective layer surface of the thus-obtained thermal recording material was 5.6.

| | |
|---|---|
| 10% DM-17 aqueous solution | 150 parts |
| 20% HG-90 aqueous dispersion | 20 parts |
| DISPEX A40 | 0.03 part |
| Water | 70.8 parts |
| 30% Zinc stearate aqueous dispersion | 7 parts |
| Tinopal MSP | 0.2 part |
| 50% Lactic acid aqueous solution | 3 parts |
| 25% Ammonia aqueous solution | 1.3 parts |
| 8% Adipic acid dihydrazide aqueous solution | 18 parts |

Example 20

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 8.1, and the surface pH of the protective layer surface of the thus-obtained thermal recording material was 4.3.

| | |
|---|---|
| 10% DF-17 aqueous solution | 150 parts |
| 30% Martifin OL-107 aqueous dispersion | 13 parts |
| Water | 76 parts |
| 0.05% Hydrochloric acid aqueous solution | 0.3 part |
| 25% Ammonia aqueous solution | 13 parts |
| 8% Dodecanedioic acid dihydrazide aqueous solution | 18 parts |

Example 21

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours,

| | |
|---|---|
| 10% DF-17 aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

and further, in the (4) making of a thermal recording material in Example 1, the neutral woodfree paper having a basis weight of 50 g/m$^2$ was replaced with acidic woodfree paper having a basis weight of 50 g/m$^2$ and having a surface pH of 5.8 on the side where the thermal recording layer was to be formed. The aqueous coating liquid for a protective layer had a pH of 8.5, and the surface pH of the protective layer surface of the thus-obtained thermal recording material was 5.1.

Example 22

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours,

| | |
|---|---|
| 10% DF-17 aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Aidpic acid dihydrazide aqueous solution | 18 parts |

and further, in the (4) making of a thermal recording material in Example 1, the neutral woodfree paper having a basis weight of 50 g/m$^2$ was replaced with basic woodfree paper having a basis weight of 50 g/m$^2$ and having a surface pH of 8.2 on the side where the thermal recording layer was to be formed. The aqueous coating liquid for a protective layer had a pH of 8.4, and the surface pH of the protective layer surface of the thus-obtained thermal recording material was 6.2.

Example 23

An aqueous coating liquid for a protective layer in the (3) preparation of an aqueous coating liquid for a protective layer in Example 1 was prepared by mixing the following amounts of the following materials in the following order and stirring the mixture for 2 hours. Further, in the (4) making of a thermal recording material in Example 1, the coating liquid for an undercoating layer, the coating liquid for a thermal recording layer and aqueous coating liquid for a protective layer were consecutively air-knife coated on neutral woodfree paper having a basis weight of 50 g/m$^2$ in a take-up state such that the coating amount of the coating liquid for an undercoating layer was 9 g/m$^2$, that the coating amount of the dye precursor was 0.5 g/m$^2$ and that the coating amount of the coating liquid for a protective layer was 2 g/m$^2$ and the applied coating liquids were consecutively dried to form an undercoating layer, a thermal recording layer and a protective layer. Then, the thus-obtained material was calender-treated and taken up with the protective layer outside, to make a thermal recording material. The aqueous coating liquid for a protective layer had a pH of 8.5, and the surface pH of the protective layer surface of the thus-obtained thermal recording material was 5.8.

| | |
|---|---|
| 10% DF-17 aqueous solution | 150 parts |
| 30% Martifin OL-107 aqueous dispersion | 13 parts |
| Water | 85 parts |
| 50% Lactic acid aqueous solution | 3 parts |
| 25% Ammonia aqueous solution | 1.3 parts |
| 8% Dodecanedioic acid dihydrazide aqueous solution | 18 parts |

Example 24

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 7.6, and the surface pH of the protective layer surface of the thus-obtained thermal recording material was 5.5.

| | |
|---|---|
| 10% DF-17 aqueous solution | 150 parts |
| 30% Martifin OL-107 aqueous dispersion | 13 parts |
| Water | 87.5 parts |
| Ammonium sulfate | 1.8 parts |
| 8% Dodecanedioic acid dihydrazide aqueous solution | 18 parts |

Comparative Example 1

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 3.2.

| | |
|---|---|
| 10% DM-17 aqueous solution | 150 parts |
| 30% Martifin OL-107 aqueous dispersion | 13 parts |
| Water | 86.3 parts |
| 50% Lactic acid aqueous solution | 3 parts |
| 8% Adipic acid dihydrazide aqueous solution | 18 parts |

Comparative Example 2

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 9.8, and the surface pH of the protective layer surface of the thus-obtained thermal recording material was 7.2.

| | |
|---|---|
| 10% DM-17 aqueous solution | 150 parts |
| 30% Martifin OL-107 aqueous dispersion | 13 parts |
| Water | 88 parts |
| 25% Ammonia aqueous solution | 1.3 parts |
| 8% Adipic acid dihydrazide aqueous solution | 18 parts |

Comparative Example 3

A thermal recording material was made in the same manner as in Example 1 except that an aqueous coating liquid for a protective layer in the (3) preparation of an aqueous coating liquid for a protective layer in Example 1 was prepared by mixing the following amounts of the following materials in the following order and stirring the mixture for 2 hours. The aqueous coating liquid for a protective layer had a pH of 7.3, and the surface pH of the protective layer surface of the thus-obtained thermal recording material was 6.9.

| | |
|---|---|
| 10% DM-17 aqueous solution | 150 parts |
| 30% Martifin OL-107 aqueous dispersion | 13 parts |
| Water | 89.3 parts |
| 8% Adipic acid dihydrazide aqueous solution | 18 parts |

The thermal recording materials made in the above Examples 1 to 24 and Comparative Examples 1 to 3 were subjected to the following evaluations. Table 1 shows the results of Examples 1 to 6, Table 2 shows the results of Examples 7 to 12, Table 3 shows the results of Examples 13 to 19, and Table 4 shows the results of Examples 20 to 24 and Comparative Examples 1 to 3.

[Speed of Achieving Water Resistance]

The thus-obtained thermal recording materials were evaluated as follows. A thermal recording material immediately after it was dried was placed in a 23° C./65% RH environment and left there for 24 hours, and then two pieces having a size of 5 cm×5 cm were taken by cutting. One water drop was fallen on the protective layer surface of one of the thus-prepared pieces of the thermal recording material, the other piece was stacked thereon such that the protective layer surfaces were in contact with each other, and the resultant set was left in a 23° C./65% RH environment for 24 hours in a state where a load of 3 kg was exerted. Then, the two pieces of the thermal recording material were manually separated from each other. The thermal recording material was evaluated for a speed of achieving water resistance on the basis of adherence degrees of protective layers of the two pieces. The evaluation was made according to the following ratings.

AA: Protective layer surfaces are spontaneously separable.

A: Protective layer surfaces are adherent to each other but easily separable.

B: Protective layer surfaces are adherenet to each other and hard to separate, and coating layer(s) is/are partly separated.

X: Protective layer surfaces are adherent to each other and are not separable, or most parts of coating layers are separated when they are separated.

[Water Resistance]

The thus-obtained thermal recording materials were evaluated as follows. A thermal recording material immediately after it was dried was placed in a 23° C./65% RH environment and left there for one week, and then two pieces having a size of 5 cm×5 cm were taken by cutting. One water drop was fallen on the protective layer surface of one of the thus-prepared pieces of the thermal recording material, the other piece was stacked thereon such that the protective layer surfaces were in contact with each other, and the resultant set was left in a 23° C./65% RH environment for 24 hours in a state where a load of 3 kg was exerted. Then, the two pieces of the thermal recording material were manually separated from each other. The thermal recording material was evaluated for water resistance on the basis of adherence degrees of protective layers of the two pieces. The evaluation was made according to the following ratings.

AA: Protective layer surfaces are spontaneously separable.

A: Protective layer surfaces are adherent to each other but easily separable.

B: Protective layer surfaces are adherenet to each other and hard to separate, and coating layer(s) is/are partly separated.

X: Protective layer surfaces are adherent to each other and are not separable, or most parts of coating layers are separated when they are separated.

[Coating Liquid Stability]

An aqueous coating liquid for a protective layer was prepared in a 23° C./65% RH environment, and then, while it was stirred in the same environment, days were counted until coating with the aqueous coating liquid was no longer possible since it underwent gelation.

[Barrier Property]

The thermal recording materials obtained above were evaluated as follows. A thermal recording material immediately after it was dried was placed in a 23° C./65% RH environment and left there for 24 hours, and then its protective layer surface was lightly rubbed five times with cloth soaked with 5 ml of a solvent mixture containing 4 parts of toluene and 6 parts of ethyl acetate. After this treatment, the thermal recording material was evaluated for a degree of color development that took place on the surface thereof. The evaluation was made according to the following ratings.

AA: No color is developed.

A: Almost no color is developed.

B: A color is developed, but it takes a time from the contact with a solvent to the development of a color.

X: A color is developed upon the contact with a solvent.

[Anti-Sticking Property]

The thermal recording materials obtained above were evaluated as follows. A thermal recording material immediately after it was dried was placed in a 23° C./65% RH environment and left there for one week. Then, a printing test was carried out in a 23° C./65% RH environment with a handy terminal printer [PREA CT-1: supplied by Canon, Inc.], and the thermal recording material was evaluated for a white streak-like printing omission and a sticking noise in the printing. The evaluation was made according to the following ratings.

AA: No printing omission occurs, and a sticking noise is low.

A: No printing omission occurs, but a sticking noise is high.

B: Printing omission occurs partly, and a sticking noise is high.

X: Printing omission occurs intensely, and a sticking noise is high.

[Color Development Sensitivity]

The thermal recording materials obtained above were evaluated as follows. A thermal recording material immediately after it was dried was placed in a 23° C./65% RH environment and left there for one week. Images were printed out with a printing tester [TH-PMD: supplied by Ohkura Electric Co., Ltd.] with a thermal head having a dot density of 8 dots/mm and a head resistance of 1,510Ω under an electric application of a head voltage of 21 V and pulse widths of 1.0 msec. and 1.4 msec. The image was evaluated for a print density with a reflection densitometer [RD-19I: supplied by GretagMacbeth]. The evaluation was made according to the following ratings.

AA: An image portion obtained at a pulse width of 1.0 msec., had an optical density of 1.2 or more.

A: An image portion obtained at a pulse width of 1.0 msec., had an optical density of less than 1.2, and an image portion obtained at a pulse width of 1.4 msec., had an optical density of 1.2 or more.

B: An image portion obtained at a pulse width of 1.4 msec., had an optical density of less than 1.2.

X: No color was developed.

[Whiteness]

The thermal recording materials obtained above were evaluated as follows. A thermal recording material immediately after it was dried was placed in a 23° C./65% RH environment and left there for one week. Then, it was evaluated for a whiteness with a whiteness meter [PF-10: supplied by Nippon Denshoku Industries Co., Ltd.]. The evaluation was made according to the following ratings.

AA: Whiteness of 95 or more.

A: Whiteness of 90 or more but less than 95.

B: Whiteness of 85 or more but less than 90.

X: Whiteness of less than 85.

TABLE 1

| | Water resistance | Speed of achieving water resistance | Stability of coating liquid |
|---|---|---|---|
| Ex. 1 | A | A | 2 days |
| Ex. 2 | A | AA | 2 days |
| Ex. 3 | A | AA | 5 days |
| Ex. 4 | A | AA | 7 days |
| Ex. 5 | A | AA | 7 days or more |
| Ex. 6 | A | AA | 3 days |

Ex. = Example

TABLE 2

| | Water resistance | Speed of achieving water resistance | Stability of coating liquid | Barrier property |
|---|---|---|---|---|
| Ex. 7 | AA | A | 4 days | A |
| Ex. 8 | AA | A | 6 days | A |
| Ex. 9 | AA | A | 3 days | AA |
| Ex. 10 | AA | A | 4 days | AA |
| Ex. 11 | AA | A | 6 days | AA |
| Ex. 12 | AA | AA | 5 days | AA |

Ex. = Example

TABLE 3

| | Water Resistance | Speed of achieving water resistance | Coating liquid stability | Barrier property | Color development sensitivity | Anti-sticking property | Whiteness |
|---|---|---|---|---|---|---|---|
| Ex. 13 | AA | AA | 5 days | A | AA | A | A |
| Ex. 14 | AA | AA | 5 days | A | AA | A | A |
| Ex. 15 | AA | AA | 4 days | AA | A | A | A |
| Ex. 16 | AA | AA | 5 days | AA | A | A | A |
| Ex. 17 | AA | AA | 5 days | AA | A | AA | A |

TABLE 3-continued

| | Water Resistance | Speed of achieving water resistance | Coating liquid stability | Barrier property | Color development sensitivity | Anti-sticking property | Whiteness |
|---|---|---|---|---|---|---|---|
| Ex. 18 | AA | AA | 5 days | AA | A | A | AA |
| Ex. 19 | AA | AA | 5 days | AA | AA | AA | AA |

Ex. = Example

TABLE 4

| | Water resistance | Speed of achieving Water resistance | Coating liquid stability | Barrier property |
|---|---|---|---|---|
| Ex. 20 | A | AA | 2 days | A |
| Ex. 21 | AA | AA | 4 days | A |
| Ex. 22 | AA | A | 5 days | A |
| Ex. 23 | AA | AA | 4 days | AA |
| Ex. 24 | AA | AA | 3 days | A |
| CEx. 1 | Impossible to evaluate | Impossible to evaluate | Impossible to coat | Impossible to evaluate |
| CEx. 2 | X | X | 7 days or more | B |
| CEx. 3 | X | X | 7 days or more | B |

Ex. = Example, CEx. = Comparative Example

As is seen from Tables 1 to 4, Examples 1 to 23 are excellent over Comparative Example 1 in coating liquid stability. In the former, an ammonia aqueous solution that is a volatile amine is added to the coating liquid for a protective layer.

Examples 1 to 23 are excellent over Comparative Examples 2 and 3 in water resistance and the speed of achieving water resistance. In the former, the protective layer contains lactic acid or hydrochloric acid that is an Arrhenius acid.

As is seen from Table 1, Examples 2 to 6 are excellent over Example 1 in the speed of achieving water resistance. In the former, the surface pH of the formed protective layer is adjusted to less than 6.

Examples 3 to 6 are excellent over Examples 1 and 2 in coating liquid stability. In the former, the pH of the aqueous coating liquid for a protective layer is adjusted to 7 or more.

Example 4 is excellent over Example 3 in coating liquid stability. In the former, the pH of the aqueous coating liquid for a protective layer is adjusted to 8 or more.

Example 5 is excellent over Example 4 in coating liquid stability. In the former, the Arrhenius acid, an ammonia aqueous solution and the crosslinking agent are added in this order when the aqueous coating liquid for a protective layer is prepared.

Example 6 is inferior to Examples 3 to 5 in coating liquid stability. In the former, the crosslinking agent, the Arrhenius acid and the ammonium aqueous solution are added in this order when the aqueous coating liquid for a protective layer is prepared.

As is seen from Tables 1 and 2, Examples 7 to 12 are excellent over Examples 1 to 6 in water resistance. In the former, the protective layer contains the diacetone-modified polyvinyl alcohol.

As is seen from Table 2, Example 8 is excellent over Example 7 in coating liquid stability. In the former, the protective layer contains a diacetone-modified polyvinyl alcohol having a polymerization degree of 1,000 and a saponification degree of 98.5%.

Example 9 is excellent over Examples 7 and 8 in barrier property but is poor in coating liquid stability. In the former, the protective layer contains a diacetone-modified polyvinyl alcohol having a polymerization degree of 3,000 and a saponification degree of 98.5%.

Examples 10 to 12 are equivalent to Example 9 in barrier property and excellent over Example 9 in coating liquid stability. In the former, the protective layer contains a diacetone-modified polyvinyl alcohol having saponification degree of 96.5%.

Example 11 is excellent over Example 10 in coating liquid stability. In the former, the protective layer contains a diacetone-modified polyvinyl alcohol having a polymerization degree of 1,700 and a saponification degree of 96.5%.

Example 12 is excellent over Examples 7 to 11 in the speed of achieving water resistance and exhibits good coating liquid stability and barrier property. In the former, the protective layer contains a diacetone-modified polyvinyl alcohol having a polymerization degree of 1,700 and a saponification degree of 96.5% and adipic acid dihydrazide.

As is seen from Tables 2 and 3, Examples 13 to 19 are excellent over Example 7 in the speed of achieving water resistance and coating liquid stability, and exhibit good water resistance. In Examples 13 to 19, the Arrhenius acid, the ammonia aqueous solution and the adipic acid dihydrazide are added in this order when the aqueous coating liquid for a protective layer is prepared, and each aqueous coating liquid for a protective layer has a pH of 8 or more. Further, the surface pH of each protective layer formed is less than 6, and each protective layer contains a diacetone-modified polyvinyl alcohol.

Examples 13 and 14 are excellent over Examples 15 to 18 in color development sensitivity. In Example 13 of the former, the undercoating layer contains an organic hollow particles, and in Example 14 of the former, the thermal recording layer contains 3-(N-ethyl-N-isoamyl)amino-6-methyl-7-anilinofluorane.

Examples 15 to 18 are excellent over Examples 13 and 14 in barrier property. In the former, the protective layer contains kaolin.

Examples 16 and 17 are excellent over Example 15 in coating liquid stability. In the former, the protective layer contains an acrylic dispersing agent.

Example 17 is excellent over Examples 13 to 16 in anti-sticking property. In the former, the protective layer contains a lubricant.

Example 18 is excellent over Examples 13 to 17 in whiteness. In the former, the protective layer contains a fluorescent whitener.

Example 19 exhibits good coating liquid stability, barrier property, color development sensitivity, anti-sticking property and whiteness over Examples 13 to 18. In the former, the undercoating layer contains organic hollow particles, and the protective layer contains kaolin, an acrylic dispersing agent, a lubricant and a fluorescent whitener.

As is seen from Tables 2 and 4, Example 20 is excellent over Example 7 in the speed of achieving water resistance, but is inferior in water resistance and coating liquid stability. As an Arrhenius acid, the former uses an inorganic acid, and the latter uses a hydroxy acid.

Example 21 is excellent over Example 7 in the speed of achieving water resistance. The former uses, as a substrate, woodfree paper whose surface on the side where a thermal recording layer is to be formed exhibits acidity.

Example 22 is inferior to Example 12 in the speed of achieving water resistance. The former uses, as a substrate, woodfree paper whose surface on the side where a thermal recording layer is to be formed exhibits basicity.

Example 23 is excellent over Example 7 in the speed of achieving water resistance and barrier property. In the former, the protective layer is formed by air-knife coating.

Example 24 is excellent over Example 7 in the speed of achieving water resistance, but is poor in coating liquid stability. The former uses a neutralization salt, and the latter uses the Arrhenius acid and the volatile amine.

INDUSTRIAL UTILITY

According to this invention, there can be provided a thermal recording material that has a rapid speed of achieving water resistance, that exhibits high water resistance and that can be stably produced owing to excellent coating liquid stability.

The invention claimed is:

1. A thermal recording material having a thermally color-forming thermal recording layer and a protective layer which are formed on a substrate in this order, said protective layer being a layer formed by applying an aqueous coating liquid containing a polyvinyl alcohol, a crosslinking agent, a pigment, an Arrhenius acid and a volatile amine onto the thermal recording layer and drying the applied coating liquid, wherein said aqueous coating liquid has a pH of 7 or more.

2. The thermal recording material of claim 1, wherein a surface having said protective layer formed thereon has a surface pH of less than 6 after dried.

3. The thermal recording material of claim 1, wherein said aqueous coating liquid has a pH of 8 or more.

4. The thermal recording material of claim 1, wherein said aqueous coating liquid is a coating liquid prepared by adding the Arrhenius acid, the volatile amine and the crosslinking agent in this order, a pH after the addition of the Arrhenius acid is less than 6 and a pH after the addition of the volatile amine is 7 or more.

5. The thermal recording material of claim 1, wherein said polyvinyl alcohol is a diacetone-modified polyvinyl alcohol.

6. The thermal recording material of claim 5, wherein said diacetone-modified polyvinyl alcohol has a polymerization degree of 500 or more but less than 4,000 and a saponification degree of 80% or more but less than 98%.

7. The thermal recording material of claim 1, wherein said crosslinking agent is adipic acid dihydrazide.

8. The thermal recording material of claim 1, which has at least one undercoating layer is provided between said thermal recording layer and said substrate, and the undercoating layer containing organic hollow particles.

9. The thermal recording material of claim 1, wherein said thermal recording layer contains a generally colorless or light color dye precursor, and the dye precursor is at least one of 3-dibutylamino-6-methyl-7-anilinofluorane, 3-(N-ethyl-N-isoamyl)amino-6-methyl-7-anilinofluorane, 3-dipentylamino-6-methyl-7-anilinofluorane, 3-(N-ethyl-4-methylphenyl)amino-6-methyl-7-anilinofluorane and 3-diethylamino-6-methyl-7-(3-methylphenylamino)fluorine.

10. The thermal recording material of claim 1, wherein the pigment in said protective layer is kaolin.

11. The thermal recording material of claim 1, wherein said protective layer contains an acrylic dispersing agent as a dispersing agent for the pigment.

12. The thermal recording material of claim 1, wherein said protective layer further contains a lubricant.

13. The thermal recording material of claim 1, wherein said protective layer contains a fluorescent whitener.

14. The thermal recording material of claim 1, wherein said Arrhenius acid is hydroxy acids.

15. The thermal recording material of claim 1, wherein a surface pH of said substrate on the side where the thermal recording layer is formed is less than 7.

16. The thermal recording material of claim 1, wherein a back coating layer is formed on a surface of said substrate opposite to the side where the thermal recording layer is formed.

17. The thermal recording material of claim 1, wherein an adhesive layer is provided on a surface of said substrate opposite to the side where the thermal recording layer is formed.

18. The thermal recording material of claim 17, wherein a release sheet is provided on a surface of said substrate opposite to the side where the thermal recording layer is formed.

19. The thermal recording material of claim 1, wherein a magnetic recording layer is provided on a surface of said substrate opposite to the side where the thermal recording layer is formed.

20. A process for producing a thermal recording material having a thermally color-forming thermal recording layer and its protective layer formed on a substrate in this order, which comprises applying an aqueous coating liquid that contains a polyvinyl alcohol, a crosslinking agent, a pigment, an Arrhenius acid and a volatile amine and that is prepared at least by adding the Arrhenius acid, the volatile amine and the crosslinking agent in this order on said thermal recording layer and drying the applied coating liquid.

21. The process for producing a thermal recording material as recited in claim 20, wherein said aqueous coating liquid has a pH of less than 6 after the addition of the Arrhenius acid and has a pH of 7 or more after the addition of the volatile amine.

22. The process for producing a thermal recording material as recited in claim 20, wherein said aqueous coating liquid is coated on the thermal recording layer with an air knife.

* * * * *